United States Patent [19]

Porte

[11] 4,317,237

[45] Mar. 2, 1982

[54] CHEST PROTECTOR

[75] Inventor: Allen L. Porte, Acton, Canada

[73] Assignee: Hughie Big Canoe, Acton, Canada

[21] Appl. No.: 141,708

[22] Filed: Apr. 18, 1980

[30] Foreign Application Priority Data

Sep. 20, 1979 [CA] Canada ..... 336054

[51] Int. Cl.[3] ..... A41D 13/00

[52] U.S. Cl. ..... 2/2

[58] Field of Search ..... 2/2, 2.5

[56] References Cited

U.S. PATENT DOCUMENTS 3,135,961 6/1964 Roderick ..... 2/2
3,162,861 12/1964 Gustafson ..... 2/2
3,366,970 2/1968 Morgan ..... 2/2
3,484,868 12/1969 Davenport ..... 2/2
3,500,472 3/1970 Castellani ..... 2/2
4,272,847 6/1981 Buhler ..... 2/2

*Primary Examiner*—Louis Rimrodt
*Attorney, Agent, or Firm*—Arne I. Fors

[57] ABSTRACT

A chest protector adapted for use with conventional shoulder harness to protect the solar plexus and diaphragm areas of a player in contact sports. The chest protector comprises an outer sheet of rigid, form retaining material and an inner sheet of shock absorbing material secured to said outer sheet. Shoulder harness lacing or micro-hook material can be used to secure the protector to the harness.

8 Claims, 6 Drawing Figures

CHEST PROTECTOR

BACKGROUND OF THE INVENTION

This invention relates to a body protector and, in particular, relates to a chest protector adapted to be used with harness for shoulder pads.

Protective pads and associated harness are well known and commonly used in contact sports such as hockey, lacrosse, football and the like to protect the shoulders, kidneys, thighs and knees of the participants. However, the lower front central area of the chest below the sternum containing the solar plexus normally is not protected by conventional padding and is vulnerable to sharp blows from hockey sticks or pucks, knees, helmets and the like hard objects.

SUMMARY OF THE INVENTION

It is a principal object of the present invention to provide a chest protector which can be supported by and used in combination with conventional shoulder harness to protect the solar plexus area of a player's body.

It is another important object of the present invention to provide a chest protector which is simple in construction and inexpensive to manufacture. Another important object of my invention is the provision of a novel protector which is light in weight and which does not restrict the user's free movement during participation in a sport but is capable of receiving and safely distributing a severe localized impact over a relatively large area.

The foregoing and other objects of the invention are accomplished by my protector comprising the combination of an outer sheet of rigid, form retaining material and an inner sheet of shock absorbing material secured to the outer sheet, and means for securing said protector to the front portion of shoulder harness.

The construction of my invention and the manner in which it can be used will become apparent from the following detailed descriptions of the embodiment illustrated in the accompanying drawings.

Like reference characters refer to like parts throughout the description of the drawings.

DESCRIPTION OF THE PREFERRED EMBODIMENTS

Figure 1:
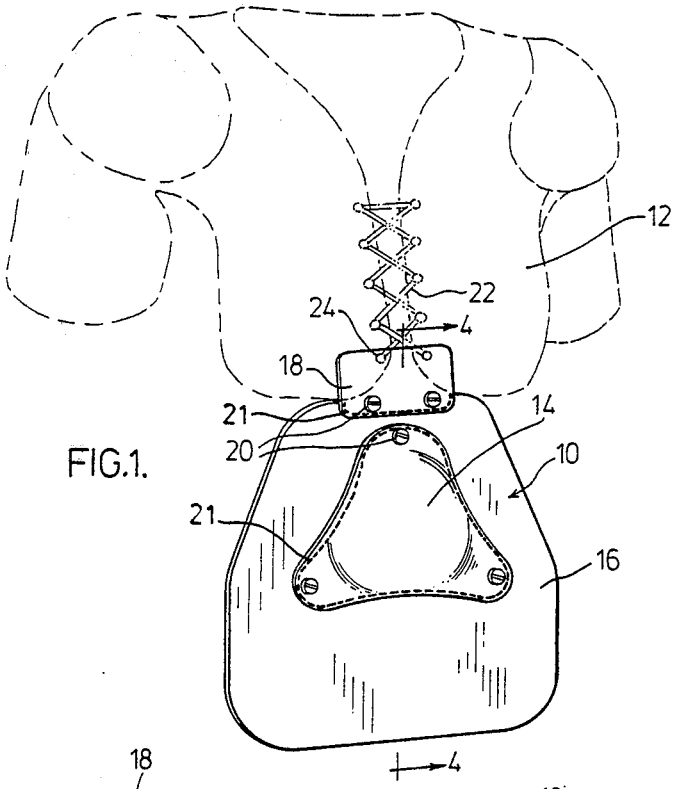
FIG. 1 is a perspective view of a first embodiment of my invention secured to and supported by conventional shoulder harness.

FIG. 1 depicts a preferred embodiment of the protector 10 of my invention in its operable position secured to and supported by a shoulder harness 12 shown by broken lines. Protector 10 comprises an outer sheet 14 of planar or concavo-convex cross-section of sufficient size to overlie and protect the solar plexus area and diaphragm of a player and is formed of a plastics material having sufficient form-retaining and rigid characteristics to receive sharp localized impact and to distribute said impact over the area of the said sheet. I have found that generally rigid material such as polycarbonate or polyurethane provides appropriate impact distributing characteristics.

The inner sheet 16 preferably is formed of sponge rubber, styrofoam or the like flexible, resilient, foam material suitable for functioning as a shock absorbing layer and enhance the impact cushioning effect of the rigid outer sheet 14.

Figure 4:
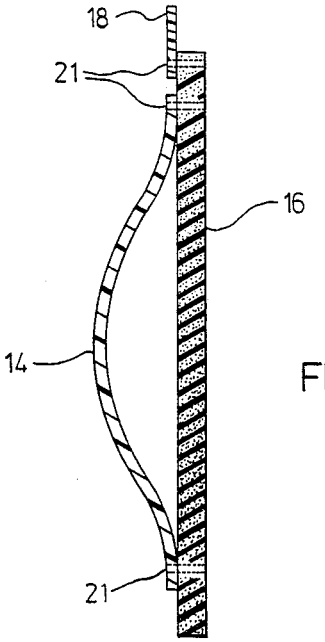
FIG. 4 is a longitudinal section taken along line 4—4 of FIG. 1 illustrating the generally concavo-convex cross-section of the rigid, form retaining material mounted on the shock absorbing material.
Figure 5:
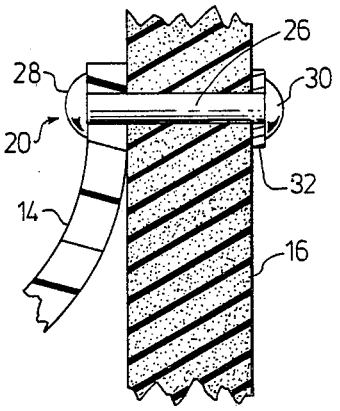
FIG. 5 is an enlarged section of securing means for joining the rigid, form retaining material to the shock absorbing material.
Figure 6:
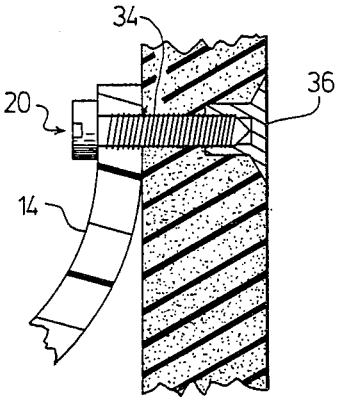
FIG. 6 is an enlarged section of another embodiment of securing means for joining the sections together.

The chest protector 10 is shown secured to the lower front section of shoulder harness 12 by means of a planar connector 18 formed of leather or flexible plastic such as vinyl secured at its lower end to the top of protector 10 by rivets or screws 20, shown in more detail in FIGS. 5 and 6, dome fasteners (not shown), and/or stitching 21, shown in FIG. 4, and secured to the shoulder harness at its opposite end by the harness lacing 22 passing through eyes 24. Thus protector 10 normally can be readily secured to standard shoulder harnesses commonly used.

It may be preferred to join the upper portion of connector 18 to the shoulder harness 12 by mating adhesive patches (not shown) such as micro-hook material, sold under the trade mark VELCRO, attached to the connector 18 and harness 12 by stitching or the like.

FIGS. 1 and 4 illustrate the use of stitching 21 and FIGS. 1–3 and FIGS. 5 and 6 illustrate typical connectors 20 for securing rigid sheet 14 to flexible sheets 16. For example, FIG. 5 illustrates a rivet 26 headed at each end 28,30 with a washer 32 underlying head 30 bearing on the flexible foam material 16. FIG. 6 shows a screw connector 34 passing through rigid sheet material 14 for engagement by a threaded cap 36. The foregoing connectors and/or stitching are suitable for securing a concavo-convex sheet to the resilient foam backing material. However, an adhesive such as a contact cement alone or with stitching will satisfactorily join a planar sheet 14 to the foam material 16.

Figure 2:
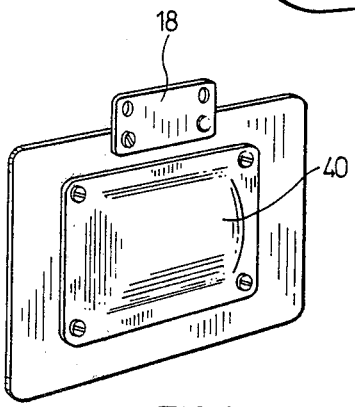
FIG. 2 is a perspective view of a second embodiment of my invention.
Figure 3:
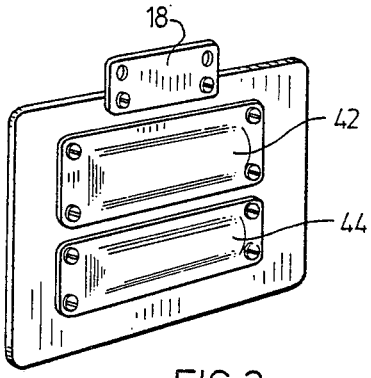
FIG. 3 is a third embodiment of my invention.

The embodiment of my invention illustrated in FIG. 1 shows a rigid, shape retaining sheet 14 having a generally triangular shape with an inner resilient sheet 16 of similar configuration but of enlarged size to provide a wide margin 17 about the periphery of sheet 14. FIGS. 2 and 3 showing additional embodiments of my invention depict generally rectangular protectors having a single rectangular rigid sheet 40 in FIG. 2 and a pair of vertically separated sheets 42,44 in FIG. 3. Each of sheets 40,42,44 can be planar or concavo-convex in section, the latter shape being preferred to facilitate deflection of pucks and the like hard objects shot or thrown at the wearer.

The present invention provides a number of important advantages. Not only is the user's body movement generally uninhibited by the presence of my protective device, my protector can be incorporated in combination with conventional shoulder harness, without the need for complex ancillary supporting straps and structures, to supplement the protection afforded by conventional padding in protecting a particularly vulnerable portion of the user's body.

It will be understood of course that modifications can be made in the embodiment of the invention illustrated and described herein without departing from the scope and purview of the invention as defined by the appended claims.

What I claim as new and desire to protect by Letters Patent of the United States is:

1. A chest protector for use in combination with shoulder harness comprising an outer sheet of rigid, form-retaining material of generally concavo-convex shape and an inner sheet of flexible shock absorbing material which extends beyond said outer sheet of rigid, form-retaining material to define a peripheral margin, means for securing said sheets together to form a unitary structure, and a flexible member secured to an upper edge of the protector, said member having eyes formed therein adapted to receive a lace from the shoulder harness whereby the protector can be laced to the shoulder harness.

2. A chest protector as claimed in claim 1 in which said flexible member is leather or a flexible plastics material.

3. A chest protector as claimed in claim 1, said means for securing the chest protector to the shoulder harness comprising a flexible member of leather or flexible plastics material and mating adhesive patches of microhook material attached to the said member and shoulder harness whereby the protector can be laced to the shoulder harness.

4. A chest protector as claimed in claim 1 in which said rigid, form-retaining material has a planar shape.

5. A chest protector as claimed in claim 1 or 4 in which said rigid, form-retaining material is secured to the sheet of flexible, shock absorbing material by at least one of rivets, screws, stitching or an adhesive.

6. A chest protector as claimed in claim 1 or 4 in which said rigid, form-retaining material is polycarbonate or polyurethane.

7. A chest protector as claimed in claim 1 or 4 in which said rigid, form-retaining material is polycarbonate or polyurethane and said inner sheet is formed of flexible, resilient, foam material having the characteristics of sponge rubber or styrofoam.

8. A chest protector as claimed in claim 1, said means for securing the chest protector to the shoulder harness comprising dome fasteners.

* * * * *